US010472785B2

(12) United States Patent
Walding

(10) Patent No.: US 10,472,785 B2
(45) Date of Patent: Nov. 12, 2019

(54) SURF CONDITIONS

(71) Applicant: Daniel Walding, Lorne (AU)

(72) Inventor: Daniel Walding, Lorne (AU)

( * ) Notice: Subject to any disclaimer, the term of this patent is extended or adjusted under 35 U.S.C. 154(b) by 0 days.

(21) Appl. No.: 15/579,847

(22) PCT Filed: Jun. 21, 2016

(86) PCT No.: PCT/AU2016/000216
§ 371 (c)(1),
(2) Date: Dec. 5, 2017

(87) PCT Pub. No.: WO2016/205859
PCT Pub. Date: Dec. 29, 2016

(65) Prior Publication Data

US 2018/0355570 A1 Dec. 13, 2018

(30) Foreign Application Priority Data

Jun. 24, 2015 (AU) ..... 2015902440

(51) Int. Cl.

| | |
|---|---|
| ***E02B 3/02*** | (2006.01) |
| ***E02F 3/88*** | (2006.01) |
| ***A63G 31/00*** | (2006.01) |
| ***E02F 3/92*** | (2006.01) |

(52) U.S. Cl.
CPC ..... *E02B 3/023* (2013.01); *A63G 31/007* (2013.01); *E02F 3/8841* (2013.01); *E02F 3/9206* (2013.01); *E02B 3/02* (2013.01)

(58) Field of Classification Search
CPC ..... E02B 3/023; E02F 3/8841; E02F 3/9206
See application file for complete search history.

(56) References Cited

U.S. PATENT DOCUMENTS

| | | | |
|---|---|---|---|
| 296,483 | A | 4/1884 | Stone |
| 4,943,186 | A | 7/1990 | Van Weezenbeek |
| 5,207,531 | A | 5/1993 | Ross |
| 5,406,725 | A | 4/1995 | Breese |

(Continued)

FOREIGN PATENT DOCUMENTS

| | | | |
|---|---|---|---|
| EP | 0091264 | A1 | 10/1983 |
| WO | 03/060241 | A1 | 7/2003 |
| WO | 2009/108070 | A1 | 9/2009 |

OTHER PUBLICATIONS

International Search Report from International Patent Application No. PCT/AU2016/000216, dated Jul. 19, 2016.

(Continued)

*Primary Examiner* — Benjamin F Fiorello
(74) *Attorney, Agent, or Firm* — Greer, Burns & Crain, Ltd.

(57) ABSTRACT

A method of improving surf conditions above a seabed is provided. The seabed is at least partly formed of unrestrained sediment. The method includes moving some of the sediment to form a formation of unrestrained sediment. A grooming device is provided for improving surf conditions above a seabed. The device is movable in a direction of travel along the seabed and includes an outlet and an arrangement. The outlet is for directing, in a direction transverse to the direction of travel, a stream of water to move some of the sediment. The arrangement is for engaging the seabed to resist force resultant from the directing the stream of water.

20 Claims, 7 Drawing Sheets

(56) References Cited

U.S. PATENT DOCUMENTS

| | | | | |
|---|---|---|---|---|
| 5,546,682 | A | 8/1996 | Skerry | |
| 6,336,771 | B1 | 1/2002 | Hill | |
| 9,309,642 | B2 * | 4/2016 | Patriciu | E02F 3/8866 |
| 9,574,360 | B2 * | 2/2017 | Fincham | A63G 31/007 |
| 2003/0223818 | A1 | 12/2003 | Black | |
| 2005/0100408 | A1 | 5/2005 | de Andrade | |
| 2006/0150445 | A1 | 7/2006 | Redding | |
| 2006/0151631 | A1 | 7/2006 | Redding | |

OTHER PUBLICATIONS

Pitt, Andrew, "Beach Nourishment for Surfers," Swellnet—Surf Forums, retrieved from the internet on Dec. 5, 2017. Published Jun. 10, 2011. <http://www.swellnet.com/forums/surfing-reef-designs/11996>.

Hardman, Robert, "What a Blast! I'm a Human Dolphin: Robert Hardman Tries the Jet Pack That Can Turn You into Flipper (or, in His Case, Flopper)," Daily Mail.com—UK, retrieved from the internet on Dec. 5, 2017. Published Oct. 21, 2012. <http://dailymail.co.uk/sciencetech/article-2221200/What-blast-Im-human-dolphin-Robert-Hardman-tries-jet-pack-turn-Flipper-case-Flopper.html>.

* cited by examiner

1. Wave breaks too fast ('closeout')

2. Too slow ('fat')

3. Just right

SURF CONDITIONS

FIELD

Preferred forms of the invention relate to improving surf conditions.

BACKGROUND

Surfing is a leisure activity of significant economic value. In some areas, entire local economies are sustained by surfers visiting to take advantage of the area's favourable surf conditions.

For the avoidance of doubt, 'surfing' is used herein to take in a wide range of wave-riding activities including body-boarding and stand-up paddle boarding. 'Surf conditions' is used herein to refer to the shape and behavior of the waves.

Typically, as a set of waves approaches a shoreline the waves will slow down and 'squash' together. In more technical terms, the wave length is shortened whilst the frequency is maintained. This process is called shoaling and results in increasing wave height. Eventually lower portions of the wave slow to a speed at which they are overtaken by higher portions of the wave. This is referred to as the wave breaking.

How the waves break is an important aspect of surf conditions, and not all surfers have the same preferences. Beginners generally prefer waves that 'spill', that is, waves wherein the overtaking portions flow down the main face of the wave. More experienced surfers often prefer waves that 'pitch', that is, waves wherein the overtaking portion of the wave falls down some distance in front of the main face of the wave so as to define a tubular void in which the surfer may surf.

Whilst it is often convenient to think of waves in two dimensions, waves are in fact three-dimensional. How a wave behaves in the direction transverse to its direction of travel (i.e. transverse to the swell angle) is another important aspect of surf conditions. Many regard a wave that pitches progressively in one such transverse direction or the other as ideal. This allows for barrel riding, in which a surfer within the tubular portion of the wave follows the breaking portion of the wave before emerging from the end of the tube.

Generally speaking, surf conditions vary significantly from time to time and from place to place. It is not unusual to see surfers crowded about a relatively short portion, of a much longer beach, in which the surf conditions are more favorable. This crowding and competition for the best waves detracts from many surfers' enjoyment of the sport and limits the economic value of the beach.

Variation from time to time is also problematic. Many only have limited time for surfing and it can be very disappointing to arrive at a beach and find unfavorable surf conditions.

Changes in the tide and wind direction contribute to variations in surf condition. Some waves may break only on high or low tide. Expert surfers usually prefer offshore winds. Offshore wind tends to hold the wave crest up, improving the likelihood of the wave pitching. If the wind is onshore, the waves will more readily crumble.

With the foregoing in mind, at least a preferred form of the invention aims to improve surf conditions.

It is not admitted that any of the information in this patent specification is common general knowledge, or that the person skilled in the art could be reasonably expected to ascertain or understand it, regard it as relevant or combine it in any way before the priority date.

SUMMARY

One aspect of the invention provides a method of improving surf conditions above a seabed;

the seabed being at least partly formed of unrestrained sediment;

the method including moving some of the sediment to form a formation of unrestrained sediment.

Preferably the moving is in accordance with a plan selected to improve surf conditions, which plan may be based on at least one of:

anticipated swell intensity;

anticipated swell angle; and a target surfer preference.

Advantageously one or more portions of the formation may, in plan, each run transversely to an anticipated swell angle. Preferably the portions, in plan, each run at a respective included angle, to the anticipated swell angle, in the range of 30° to 60° inclusive. Most preferably the formation has, in plan, a zigzag profile made up of a plurality of the portions.

The moving may include directing a stream of water towards a portion of the seabed from which sediment is to be removed. This may include operating a propulsion device, e.g. a jet, of a vessel to create the stream of water. Preferably the vessel is a personal watercraft.

The moving may include the vessel towing a grooming device, and the grooming device may include a conduit for conveying the stream of water from the propulsion device.

Preferably the moving includes moving an or the grooming device in a direction of travel; and the directing a stream of water is directing in a direction transverse to the direction of travel.

Another aspect of the invention provides a grooming device for improving surf conditions above a seabed;

the seabed being at least partly formed of unrestrained sediment;

the device being movable in a direction of travel along the seabed and including an outlet for directing, in a direction transverse to the direction of travel, a stream of water to move some of the sediment; and an arrangement for engaging the seabed to resist force resultant from the directing the stream of water.

Preferably the outlet is an outlet of a conduit arranged for a propulsion device of a vessel to drive the stream of water through the conduit. The vessel may be a personal watercraft having a jet, in which case the conduit may include an inlet configured to receive the stream of water from the jet. If so, the device preferably includes a fitting by which the conduit is connectable to the personal watercraft, the fitting being configured to divide an output, of the jet, between the conduit and propelling the personal watercraft to enable grooming whilst the device is in motion.

The device may be configured to, whilst grooming, be towed in the direction of travel, preferably by the vessel.

The arrangement for engaging the seabed preferably includes at least one fin.

The device preferably includes a draw bar by which the device may be towed, in which case the draw bar preferably is constrained to pivot, relative to the arrangement for engaging, about an axis transverse to the direction of travel.

The device preferably includes at least one skid portion configured to slide over the sediment.

Another aspect of the invention provides a method, of providing a stream of water, including dividing the output of a jet of a vessel. Another aspect of the invention provides a fitting configured to divide the output of a jet of a vessel, to provide a stream of water. These aspects of the invention have application beyond improving surf conditions.

DETAILED DESCRIPTION

Figure 1A:
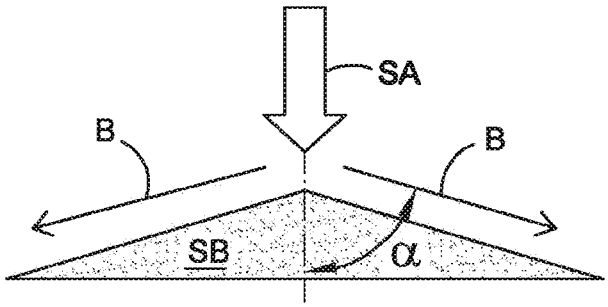
FIGS. 1*a* to 1*c* schematically illustrate sandbars.

The inventor has recognised that the shape of the seabed influences surf conditions and that surf conditions can be improved by reshaping the seabed. In particular it has been recognised that a wave will typically break when it moves into water having a depth about 1.3 times the height (peak to trough) of the wave.

The seabed may be reshaped by forming a formation. The formation may simulate a natural formation such as a reef, point or sandbar. Other formations such as filled holes or re-contoured seabeds are also possible. The formation is preferably a submerged formation.

The seabed may be reshaped by moving sediment about. 'Sediment' is used herein to refer to flowable material that at least partly makes up the seabed. The sediment may be one or more of sand, pebbles, silt and mud.

Reefs are submerged structures formed from rock or coral. Usually a reef will be located offshore and be surrounded by deeper water. The quality of the wave is determined by the shape of the reef and the angle of the swell hitting it. Because reefs are comprised of hard, rigid material, they may abruptly change the water depth from deep to shallow (and back to deep again). This abrupt change in depth causes waves to pitch significantly, and it is for this reason that many high performance waves in the world are reef breaks.

Some have attempted to improve surf conditions by creating artificial reefs. Some artificial reefs have included restrained sediment such as the sand restrained within sandbags. Others have included artificial materials such as concrete blocks or car tyres. Others still have included other non-native materials such as rock imported from elsewhere.

Point breaks are rocky or sandy features exposed above the high tide mark. The swell hits at an angle oblique to the shoreline as the wave breaks along the point. These waves can be very long because the wave can break more or less indefinitely until it eventually reaches the end of the point where the wave will 'close out' on the beach. Once again, the quality of the wave is determined by the geometry of the point and the swell direction. Point breaks may be rock-bottom or sand-bottom, or a combination. Sand-bottom points can vary in quality according to sand geometry.

Sandbars (also known as sandbanks, beach breaks, shore breaks or shore dumps) are similar to reef breaks in that they consist of an accumulation of material beneath the surface. Sandbars differ from reef breaks in that they are comprised of sand rather than hard material.

Sandbars are transient and temporary because they are strongly affected by water currents. These currents can cause the sandbar to change shape over time. As with other wave types, the wave quality of a sandbar is determined by the geometry of the seabed and the swell direction amongst other factors.

Preferred forms of the invention relate to the reshaping of sandbars, and/or other seabed features, to improve surf conditions. Advantageous methods and apparatus are disclosed herein. The apparatus include a grooming device movable in a direction of travel and capable of moving sediment transverse to that direction. The methods will now be described before returning to grooming device and other apparatus.

Figure 1B:
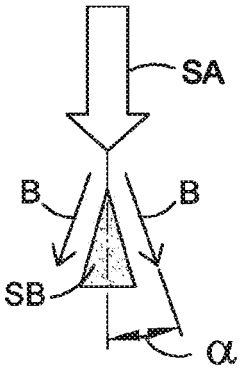
Figure 1C:
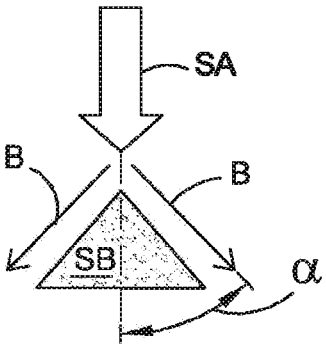

The inventor has recognised that a portion of a sandbar SB (or other projection on the seabed) running at an angle $\alpha$ of about 45°, say 30° to 60° inclusive, to the swell angle SA is highly desirable. In FIGS. 1*a* to 1*c*, the arrows B illustrate the direction in which the break will move along an angled portion of a sandbar.

FIG. 1*a* illustrates a sandbar SB having a portion at an angle $\alpha$ steeper than the desirable range. If the seaward side of the sandbar SB is steep enough to cause the wave to pitch, it will likely result in a wave that breaks too quickly to surf. That is, the point at which the wave pitches over will move, transverse to the swell angle, too quickly for a surfer to keep up. As a result, surfers will be trapped in the tubular portion of the wave and be 'dumped'.

FIG. 1*b* illustrates a sandbar SB having a portion at an angle $\alpha$ shallower than this range. It will not produce a lasting tubular wave form. Rather the wave will tend to collapse on itself.

FIG. 1*c* illustrates a sandbar SB having a portion at an angle $\alpha$ of about 45°. Appropriately contoured to produce pitching waves, it will produce a tubular break conducive to a highly sought after barrel ride.

FIGS. 1*a* to 1*c* illustrate triangular sandbars, each of which has an apex directed seawards. These sandbars are shaped to produce two breaks for each wave—one on either side of the seaward apex.

Many naturally occurring sandbars run at an angle $\alpha$ of about 90° to the swell angle. This is in essence an extreme case of what is illustrated in FIG. 1*a* and will result in the entire wave front breaking at the same time, which is referred to as the wave 'closing out'.

'Swell angle' as used herein refers to the direction in which the waves travel. Generally speaking, the swell angle is perpendicular to the wave's crest. Some literature defines a wave's 'peel angle' as the angle between:

the trail of the broken white water (i.e. the arrow B); and the crest of the unbroken wave.

As such, peel angle is approximately equal to 90° less $\alpha$.

Swell angle and peel angle are not constant. Waves change direction as they refract around undersea formations. FIG. 2*b* illustrates the swell angle SA and wave crest WC of a wave as it wraps around a teardrop-shaped island. As such, a very long sandbar running along the coast of this island and at an angle α of about 45° to the swell angle would be curved when viewed in plan.

The angle α of the break-initiating formation is an important factor that influences the quality of a surfing wave. Another important factor is the inclination of the break-initiating formation relative to the horizontal. This inclination is quantified herein by the angle θ shown in FIGS. 2*e* and 2*f*. FIGS. 2*c* and 2*d* illustrate a pair of peak formations in plan. Each side of each of the peaks has the optimal angle α of about 45°. The peaks differ by the inclination of their faces relative to horizontal.

Figure 2A:
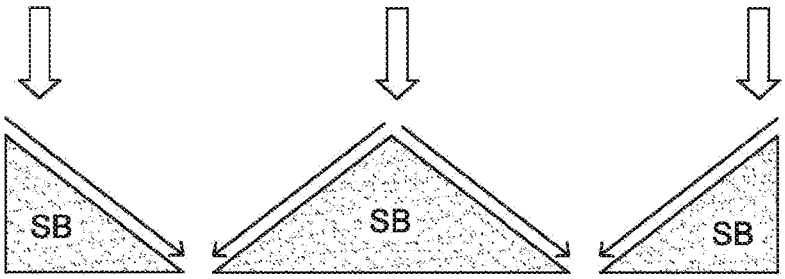
FIG. 2*a* is a schematic plan view of modified sandbars.
Figure 2B:
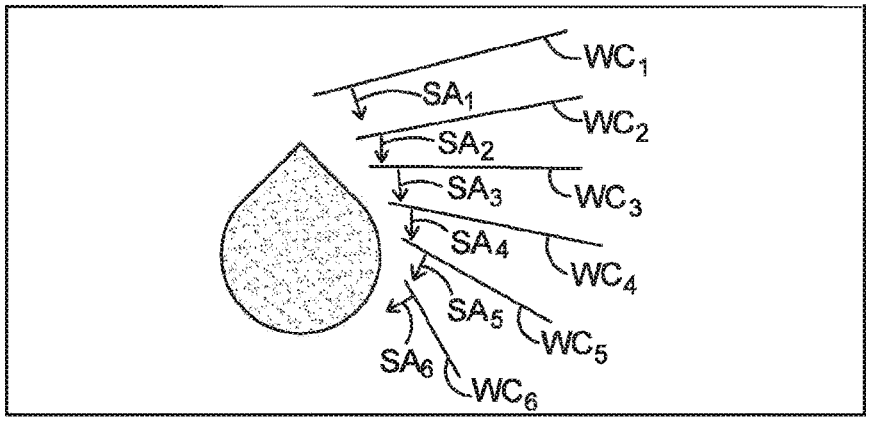
FIG. 2*b* is a schematic plan view of an island.
Figure 2C:
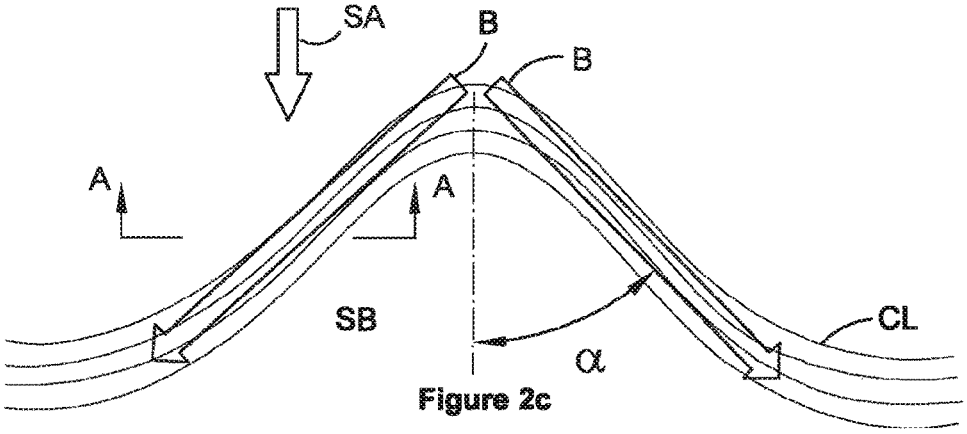
FIG. 2*c* is a schematic plan view of a peak.
Figure 2D:
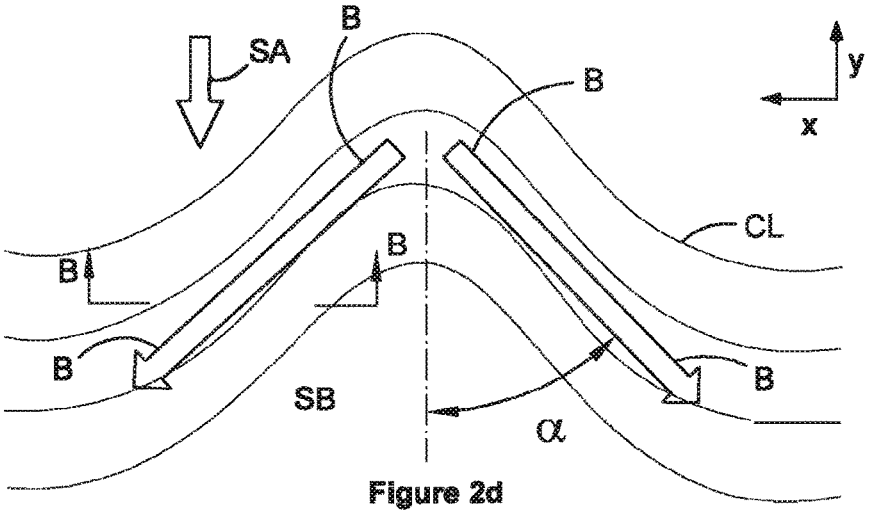
FIG. 2*d* is a schematic plan view of another peak.
Figure 2E:
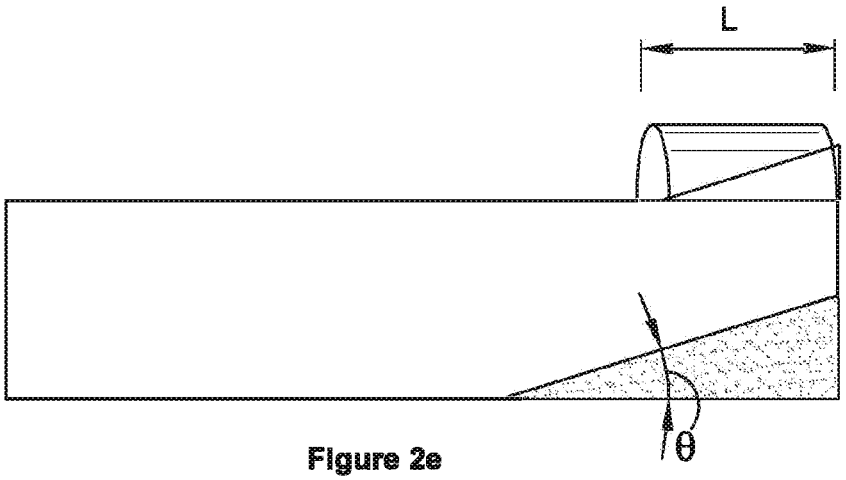
FIG. 2*e* is a vertical cross-section view corresponding to the line A-A in FIG. 2*c*.
Figure 2F:
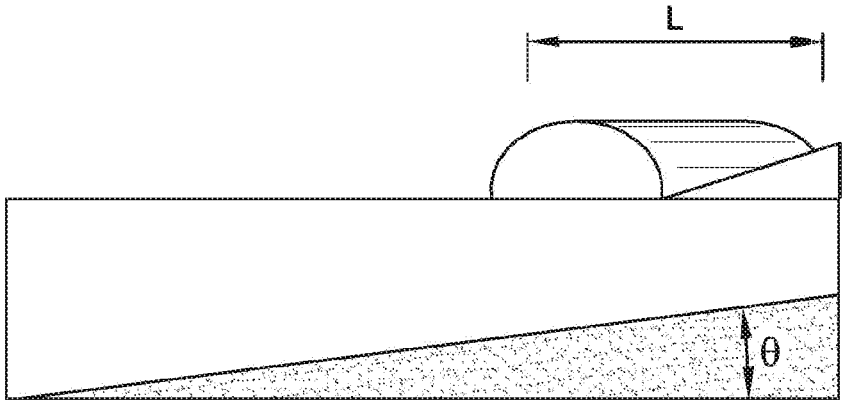
FIG. 2*f* is a vertical cross-section view corresponding to the line B-B in FIG. 2*d*.

FIGS. 2*e* and 2*f* are vertical cross-section views corresponding to the line A-A (in FIG. 2*c*) and line B-B (in FIG. 2*d*) respectively. These views are through planes perpendicular to the swell angle SA. Of course, the angle θ has a lower value than would a similar angle drawn on a cross-section view normal to the contour lines CL in the same region of the sandbar SB.

The angle θ affects the shape of the wave in the surfable region in the vicinity of the break. The surfable region is sometimes referred to as the 'power pocket'. A steep angle θ as in FIG. 2*e* leads to a short surfable region as suggested by the dimension L, whereas a shallower angle θ extends the surfable region as suggested by the dimension L in FIG. 2*f*. An angle θ of about 3° has been found to produce a long surfable region having a steep face suited to more experienced surfers. A shallower angle θ is not always better. As θ approaches 0, the geometry of the seafloor approaches that of a parallel sandbar that causes the entire wave to break simultaneously, that is, causes the wave to close out.

Improving the surf conditions may commence with an assessment of the current surf conditions and/or a survey of the seabed. This survey may entail laser and/or sonar technology, e.g. a buoy may transmit the depth of the seabed to a surveyor to enable 3D triangulation to locate points on the seabed. The inventor has recognised that technology previously applied to surveying shipping lanes may be drawn upon for this purpose.

Based on the survey results, an operator may visualise the seabed geometry, potentially with the aid of 3D model displayed on a display such as a computer screen, and based on that visualisation may plan how best to move the sediment to improve the surf conditions. This planning step may entail consideration of factors including one or more of:

anticipated swell intensity;
anticipated swell angle;
anticipated tide position;
anticipated wind intensity;
anticipated wind direction; and
a target surfer preference.

When creating a new sandbar from scratch, it might be appropriate to simply design a triangle-shaped geometry for the wave to break along. On the other hand, when improving an existing break (e.g. a sand-bottom point break), it might be appropriate to add sand to certain parts of the break and remove it from other parts.

Once the survey has been made, the artificial sandbar can be designed. An important consideration is the angle of the sandbar with respect to the prevailing swell. As noted, a sandbar that is triangle-shaped in plan allows surfers to go left or right. This type of setup is known as a 'peak'.

Advantageously, the sandbar could be configured to suit a variety of surfer competencies by changing the angle α of the grooming. Certain spots could be groomed for beginners while others could be designed for experts. A break could be designed to be fast in one direction and slower in the other, or to start slowly and then increase in speed.

As suggested in FIG. 2*a*, consecutive sandbars SB could be groomed along the whole stretch of beach so that their banks align to form a zigzag. This serves to spread out the crowds along the various breaks. It might be preferable to design some breaks suitable for beginners and others for advanced surfers, or to design banks that work in different swell angles.

During the creation of these sandbars SB, at some points the water has been made deeper to delay breaking of the waves, whereas at other points the water has been made shallower so as to advance breaking of the waves.

In a preferred form of the method, the sandbars are created by moving the grooming device in accordance with a plan. The course of the grooming device may be determined with the aid of an electronic navigation system (e.g. a GPS system) and/or an arrangement of buoys (and/or other reference points).

Scenario 1—Grooming a New Sand Bar

Figure 3:
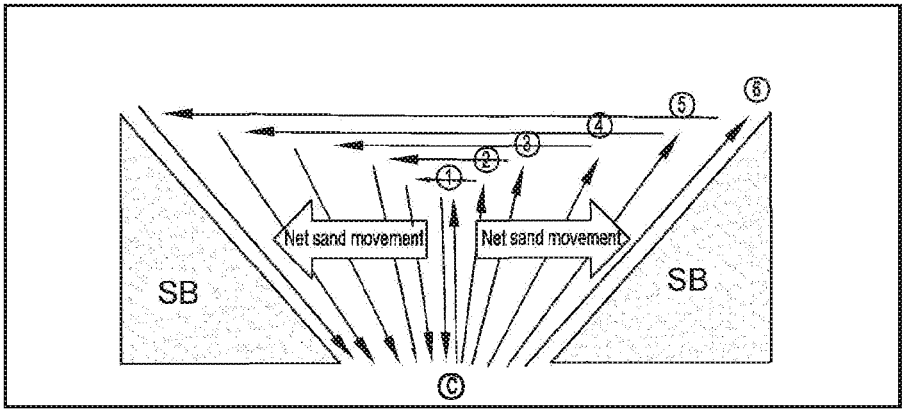

FIG. 3 illustrates a potential route for a grooming device configured to throw sediment to its right (i.e. a right-handed device). This route is arranged to create a pair of sandbars SB and a triangular deep region therebetween. The route is mapped with the aid of:

a central buoy C;
buoys 1 to 6; and
an arrangement of buoys (not shown) symmetric to buoys 2 to 6 on the other side of buoy 1.

The route is anti-clockwise and outwardly spiraling so that with each pass sediment is moved further outwards. Alternatively, a clockwise path would be appropriate for a left-handed device.

The route entails:

travelling from the central buoy C to the buoy 1; then
returning to the buoy C; then repetitively
- moving to the next of the buoys 1 to 6;
- moving to the corresponding one of the other buoys; and
- returning to the central buoy C.

Figure 4A:
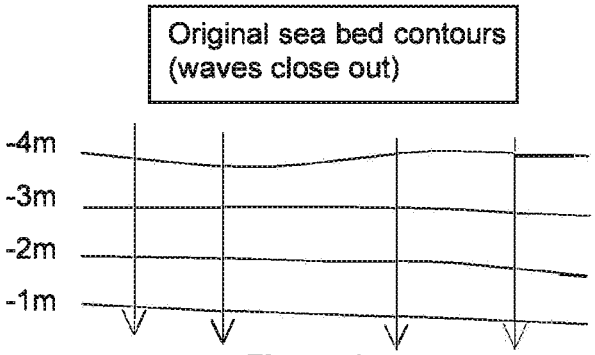
FIGS. 4*a* and 4*b* illustrate seabed contours before and after grooming.
Figure 4B:
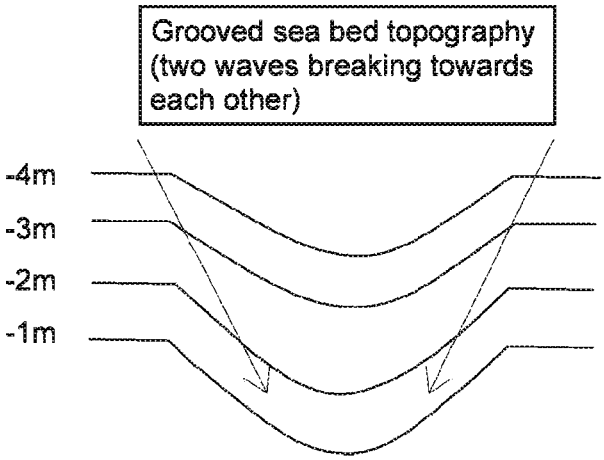

FIGS. 4*a* and 4*b* detail the seabed contours before and after the grooming operation described in FIG. 3. This contour will result in two breaks that move towards each other as they converge on the location at which the buoy C was placed.

Scenario 2—Brooming an Existing Reef or Point

In scenario 1, a new surf spot was groomed onto a basically uniform sandy surface. This produces a triangular beach break with waves that break left and right. While this can create a surfable wave, the groomed sandbar is ultimately constrained in length by the slope of the seabed.

This is because waves can only break proportionally to water depth. A steeply dipping seabed will only allow waves to break so far before the wave reaches the beach. Naturally this limits the length of wave that can be groomed on such a beach.

In contrast, point breaks (and to an extent, reef breaks) have more or less no limit on how long they can break. Some of the longest waves in the world are over a kilometer long, simply due to the length of the reef or point. All other things being equal, most surfers will much prefer a longer wave over a shorter one, so a sand-bottom point (or reef) is a candidate for grooming.

Like beach breaks, the geometry of the point or reef needs to be just right in order to create a good wave. Provided there is sufficient adjacent sediment, it is possible to use surf grooming to improve a pre-existing point or reef break.

Figure 5A:
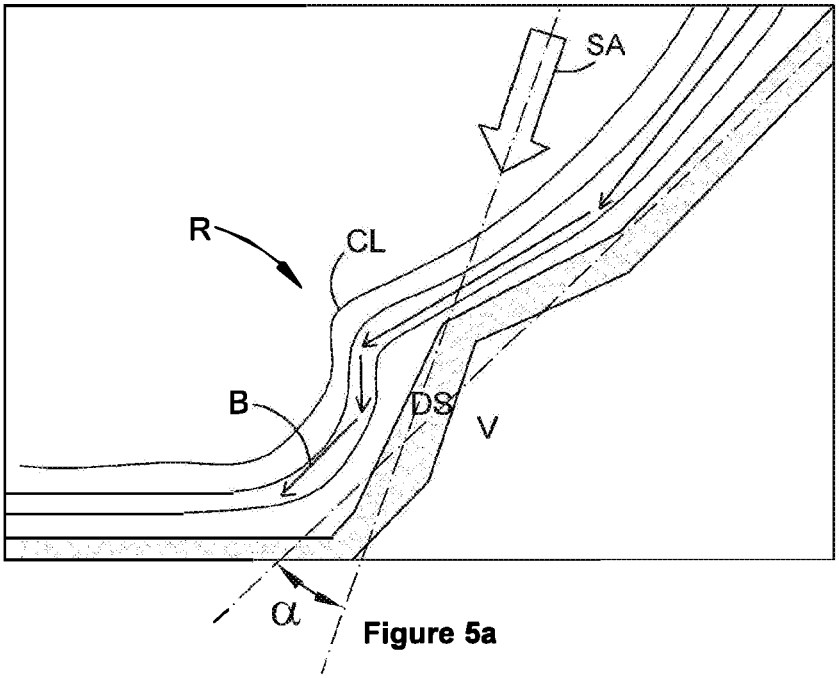
FIG. 5*a* schematically illustrates a naturally occurring point break.

FIG. 5*a* is a plan view of a hypothetical, naturally-occurring, poor quality sand-bottom point break defined by the dry sand DS of the beach which is adjacent the vegetation V above the waterline. Whilst the dry sand DS is at an angle α to the swell angle SA within the desirable 30° to 60° range, subsurface irregularities, such as the ridge R suggest by the contour lines CL, cause the break to change directions. This results in a messy wave rather than the desirable smooth barrel.

Figure 6:
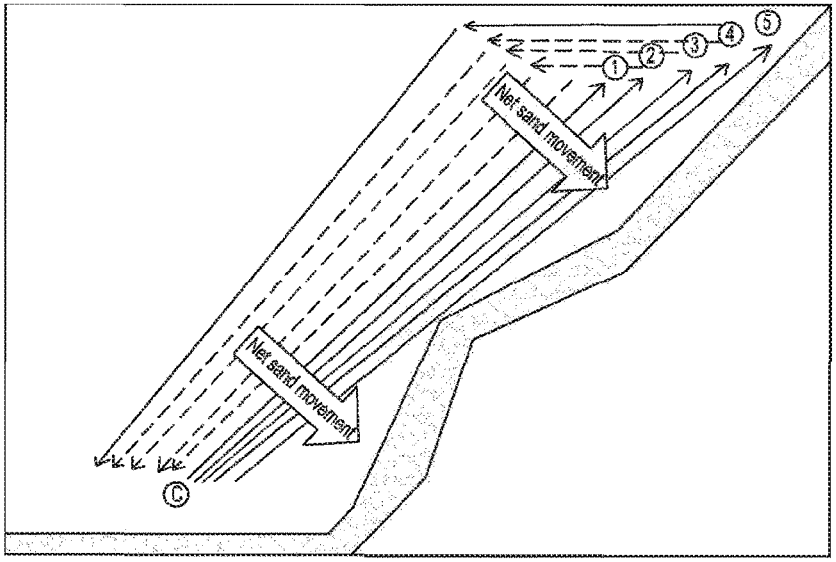
FIG. 6 illustrates a groom path for grooming the point break of FIG. 5*a*.

FIG. 6 illustrates an appropriate grooming path for a right-handed grooming device to improve the surf conditions produced by the point break of FIG. 5*a*. This grooming path incorporates active and inactive passes. During the active passes, the grooming device is active to throw sand shoreward. Each active pass is followed by an inactive pass to return to the central buoy. The groom is deactivated for its return pass so that sand is not moved seaward. Each active pass is closer to the shore than the previous active pass so that the sand is progressively moved shoreward.

Figure 5B:
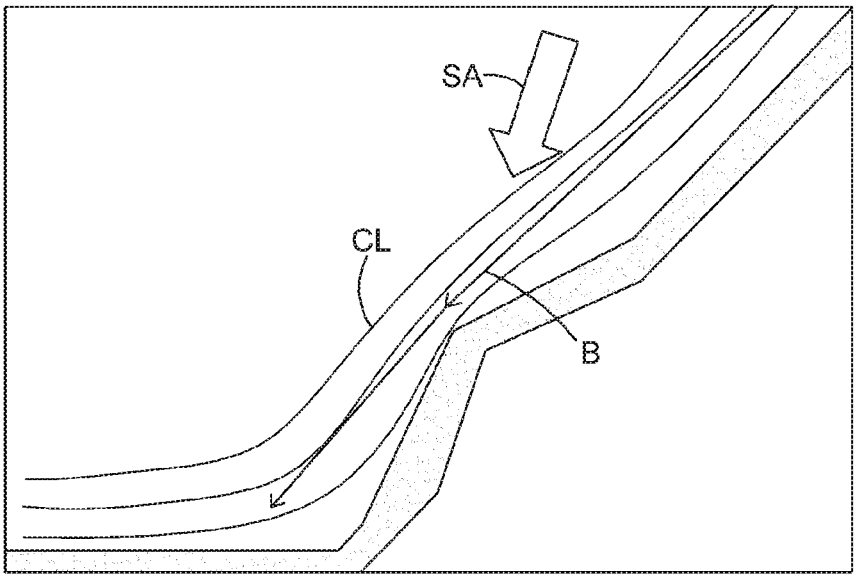
FIG. 5*b* schematically illustrates the point break of FIG. 5*a* after grooming.

FIG. 5*b* illustrates the results of this grooming. The contour lines have been straightened and in turn the break lines B have been straightened to produce a tidier wave.

Figure 7:
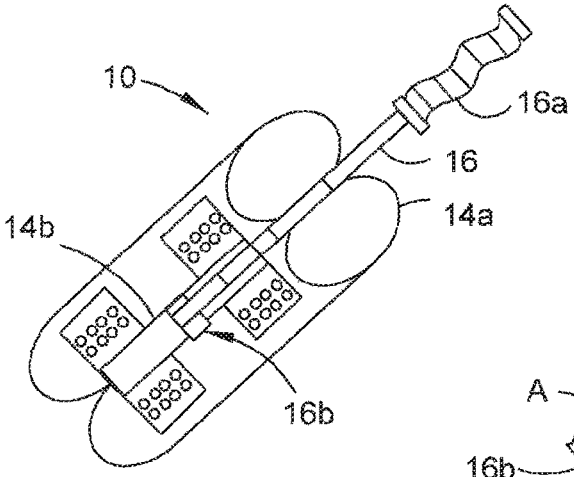
FIG. 7 is a plan view of a grooming device.
Figure 8:
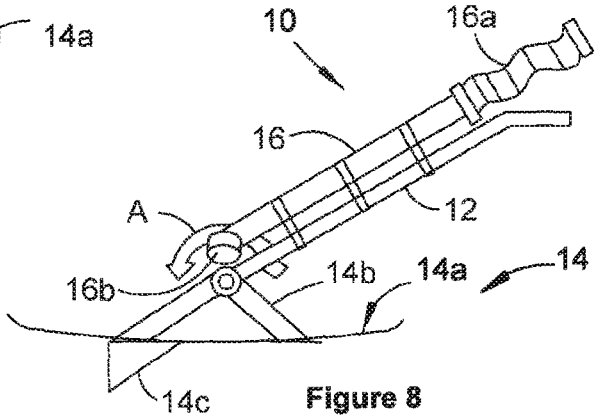
FIG. 8 is an elevation of the grooming device.

The grooming device 10 of FIGS. 7 and 8 incorporates a draw bar 12, a seabed traversing portion 14 and a supply conduit 16.

The seabed traversing portion 14 incorporates a skid arrangement 14*a*, a superstructure 14*b* atop the skid arrangement 14*a*, and a sand-engaging fin 14*c* projecting downwardly from the skid arrangement 14*a*.

An early prototype of the device 10 included a skid arrangement made up of two snowboards mounted side by side and mutually coupled by the superstructure 14*b*. Of course, this is but one example of a possible skid portion for skidding along the seabed. The upturned ends of the skid arrangement 14*a* encourage it to skid along and over the seabed, rather than dig into the sediment.

The draw bar 12 is oriented to extend upwardly at an oblique angle from the superstructure 14*b* towards a floating tow vessel. The draw bar 12 is preferably connected to the superstructure 14*b* to prevent the traversing portion 14 toppling to either side. In this example, this connection takes the form of a pivotal connection having a pivot axis substantially horizontal and substantially transverse to the direction of travel, whereby the draw bar may pivot relative to the traversing portion 14 to accommodate differences of depth whilst still holding the traversing portion 14 upright.

Figure 10:
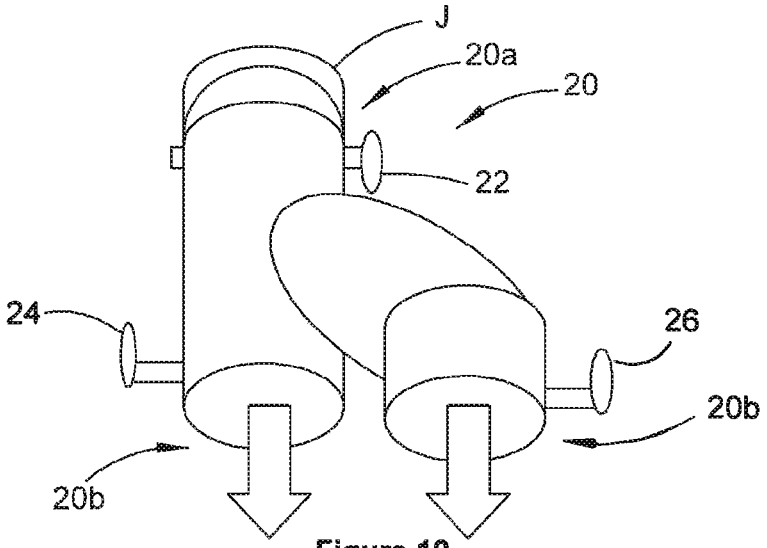
FIG. 10 is a perspective view of a hydraulic connector.
Figure 11:
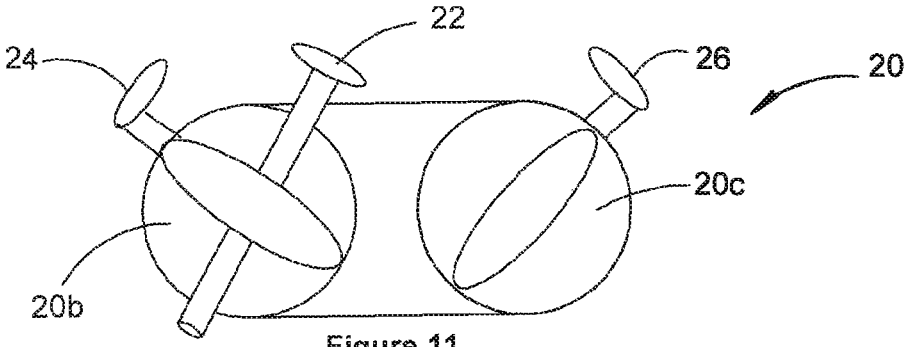
FIG. 11 is an end view of the hydraulic connector of FIG. 10.

The conduit 16 is mounted to and follows the draw bar 12 from a flexible conduit portion 16*a* at its upper end to an outlet 16*b* at its lower end. The flexible conduit portion 16*a* is in use coupled to the hydraulic connector 20 of FIG. 10 to receive an energetic stream of water therefrom. The outlet 16*a* is positioned in proximity to the pivotal connection pivotally connecting components 12, 14 and is directed downwards towards the seabed at an oblique angle and substantially perpendicular to the direction in which the device 1 travels.

The outlet 16*b* is oriented to direct the energetic stream of water to the right-hand side of the direction of travel—i.e. the groom 10 is a right-handed device as those words are used herein.

The energetic stream of water impinging on the sediment adjacent to the device serves to laterally displace that sediment. Of course, a significant reaction force from this redirection of the fluid tends to urge the structure 14 to move leftward relative to its direction of travel. The fin 14*c* is arranged to dig in to the sediment. This form of engagement serves to resist the reaction force resulting from the direction of the stream of water. Of course, the fin 14*c* is but one example of an arrangement for engaging the seabed.

Preferred forms of the device 10 incorporate a redirectable outlet 16*b* to vary the angle from vertical at which the stream of water is directed towards the seabed. This allows the sediment-moving characteristics of the groom 10 to be tuned to suit the desired surf conditions. For a constant stream intensity, steeper streams of directed water tend to displace a narrower but deeper strip of sand (i.e. to create a narrower channel) and to deposit that sand in a more steeply mounded strip. In contrast, a shallow angle of inclination tends to move a wider, shallower strip of material and likewise deposit that material over a larger, laterally-adjacent area.

Preferably the surf groom is configured in accordance with a predetermined grooming outcome. By way of example, to produce a surf break to suit beginners, the outlet 16*b* may be directed more steeply downwards and the grooming paths moved closer together to produce a steeper angle θ as in FIG. 2*c*. The grooming plan may also be modified to produce a shallower angle α. Conversely, these changes may be reversed to produce a surfable wave portion that is longer, steeper and faster to suit expert surfers.

Figure 9:
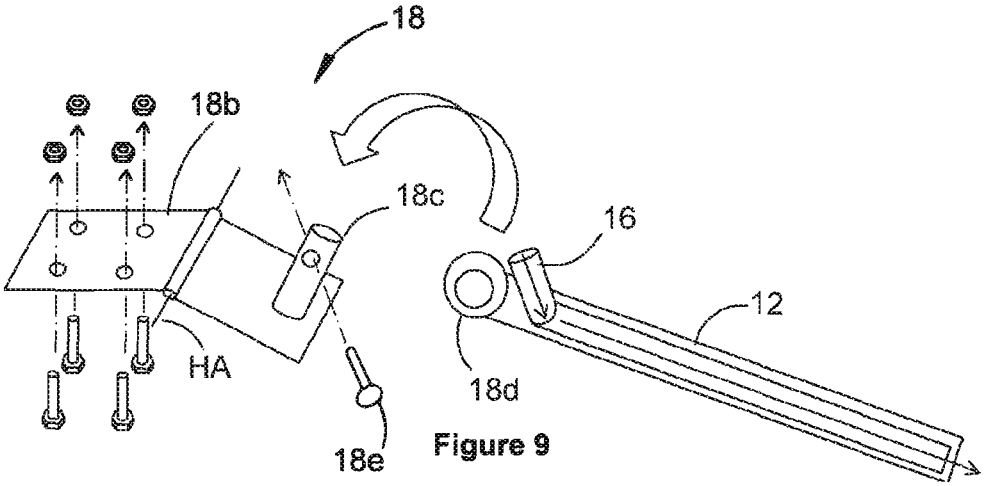
FIG. 9 schematically illustrates a hitching arrangement.

FIG. 9 illustrates a hitching arrangement 18 by which the device 10 may be hitched to a suitable tow vehicle. The arrangement 18 includes a hinge 18*b* which is in use arranged so that its hinge axis is substantially horizontal and substantially perpendicular to the direction of travel. One leaf of the hinge 18*b* is affixed to the tow vehicle with suitable fasteners. The other leaf of the hinge 18*b* is pivotally connected to the draw bar 12 to enable the draw bar to pivot about an axis perpendicular to that leaf. As such, the draw bar when connected has two degrees of pivotal freedom relative to the tow vehicle. In this example, the pivotal connection takes the form of a pin perpendicular to the free hinge leaf and encircled by an eyelet 18*d* formed at the upper end of the draw bar 12. A suitable fastener such as a cotter pin 18*e* is engaged with an aperture passing transversely through the pin 18*c* to capture the draw bar 12 on the pin 18*c*.

It will be appreciated that the two degrees of freedom provided by this joint allow the tow vehicle to turn relative to the device 10 to facilitate maneuvering of the tow vehicle and device 10 combination, and for pivoting to accommodate variations in sea depth.

Preferably the tow vehicle takes the form of a personal watercraft. The connector 20 serves to divide the output of the watercraft's jet between propelling the watercraft (and the towed device 10) and supplying the stream of water to the device 10. To this end, the coupling includes a single inlet 20*a* engageable with the jet J of the watercraft, and two outlets 20*b*, 20*c*. In the illustrated version, the inlet 20*a* includes a rubber portion which engages the jet, and a pin 22 which skewers both the outlet 20*a* and the jet J to mutually connect those components. The outlet 20*b* is coaxial with the inlet 20*a*, and in turn the jet J, and in this example serves to provide the propelling stream of water. The outlet 20*c* is at the end of a branch pipe arranged to take water from between the inlet 20*a* and the outlet 20*b*. In these examples, each of outlets 20*b*, 20*c* is fitted with a respective butterfly valve 24, 26 via which the watercraft's output may be apportioned. Of course, it is preferred that during operation at least one of the valves 24, 26 be fully opened so that the output from the watercraft is not unnecessarily restricted.

The outlet 20*c* is mated with the flexible portion 16*a* of the conduit 16. The flexible portion 16*a* serves to accommodate movement of the watercraft relative to the device 10.

An alternative version (not shown) of the grooming device 10 does without the draw bar 12. Instead the conduit 16 serves as a tow line by which the lower portions of the device are towed. This simplifies the device. Additionally, the use of a flexible towing arrangement, such as conduit 16 or other tow line, eliminates the risk of jack-knifing which may occur if the tow vehicle is pushed backwards by a wave.

Preferred forms of the invention provide for or entail the efficient relocation of native seabed material to improve surf conditions. Advantageously, this relocation is usually temporary, meaning that once grooming is halted the seabed will rapidly return to its natural state. Moreover, the method and apparatus aspects of the invention allow for the continual improvement and modification of the seabed contours to adapt to changing environmental conditions and surfer preferences, and this grooming can safely proceed whilst surfing continues. For example, the device 10 may be towed about by a personal watercraft and operated whilst surfing goes on, in contrast to the heavy machinery that may be required to reconfigure existing artificial reefs.

While the above description refers to embodiments, it will be appreciated that other embodiments can be adopted by way of different combinations of features. Such embodiments fall within the spirit and scope of this invention.

The invention claimed is:

1. A method of improving surf conditions above a seabed, the seabed being at least partly formed of unrestrained sediment, the method comprising:

moving some of the sediment to form a formation of unrestrained sediment that improves surf conditions; and the moving comprising directing a stream of water towards a portion of the seabed from which sediment is to be moved, wherein one or more portions of the formation, in plan, each run transversely to an anticipated swell angle.

2. The method of claim 1, wherein the moving is in accordance with a plan based on at least one of:

anticipated swell intensity; and anticipated swell angle.

3. The method of claim 1, wherein the portions, in plan, each run at a respective included angle, to the anticipated swell angle, in the range of 30° to 60° inclusive.

4. The method of claim 1, wherein the formation has, in plan, a zigzag profile made up of a plurality of the portions.

5. The method of claim 1, further comprising operating a propulsion device of a vessel to create the stream of water.

6. The method of claim 5, wherein the propulsion device is a jet.

7. The method of claim 6, wherein the vessel is a personal watercraft.

8. The method of claim 5, wherein the moving includes the vessel towing a grooming device; and the grooming device includes a conduit for conveying the stream of water from the propulsion device.

9. The method of claim 8, wherein the moving includes moving the grooming device in a direction of travel; and the directing a stream of water is directing in a direction transverse to the direction of travel.

10. A method of improving surf conditions above a seabed, the seabed being at least partly formed of unrestrained sediment, the method comprising:

moving some of the sediment to form a formation of unrestrained sediment that improves surf conditions, the moving comprising directing a stream of water towards a portion of the seabed from which sediment is to be moved; and operating a propulsion device of a vessel to create the stream of water.

11. The method of claim 10, wherein the propulsion device is a jet.

12. The method of claim 11, wherein the vessel is a personal watercraft.

13. The method of claim 10, wherein the moving includes the vessel towing a grooming device; and the grooming device includes a conduit for conveying the stream of water from the propulsion device.

14. The method of claim 13, wherein the moving includes moving the grooming device in a direction of travel; and the directing a stream of water is directing in a direction transverse to the direction of travel.

15. A method of improving surf conditions above a seabed, the seabed being at least partly formed of unrestrained sediment, the method comprising:

moving some of the sediment to form a formation of unrestrained sediment that improves surf conditions; and the moving comprising directing a stream of water towards a portion of the seabed from which sediment is to be moved, wherein:

the moving includes moving a grooming device in a direction of travel; and the directing a stream of water is directing in a direction transverse to the direction of travel.

16. A grooming device for improving surf conditions above a seabed, the seabed being at least partly formed of unrestrained sediment, the grooming device being movable in a direction of travel along the seabed, the grooming device comprising:

an outlet for directing, in a direction transverse to the direction of travel, a stream of water to move some of the sediment; and an arrangement for engaging the seabed to resist force resultant from the directing the stream of water, wherein the outlet is an outlet of a conduit arranged for a propulsion device of a vessel to drive the stream of water through the conduit;

the vessel has a jet and the conduit comprises an inlet configured to receive the stream of water from the jet;

the device comprises a fitting by which the conduit is connectable to the vessel; and the fitting is configured to divide an output, of the jet, between the conduit and propelling the vessel to enable grooming while the grooming device is in motion.

17. The grooming device of claim 16 configured to be towed by the vessel while grooming.

18. The device of claim 16, wherein the arrangement for engaging the seabed includes at least one fin.

19. The device of claim 16, further comprising at least one skid portion configured to slide over the sediment.

20. The device of claim 16, wherein the vessel is a personal water-craft.

* * * * *